US008684656B2

(12) United States Patent
Hilsden et al.

(10) Patent No.: US 8,684,656 B2
(45) Date of Patent: Apr. 1, 2014

(54) LOADER MAST-TO-MOUNTING FRAME PIN RETAINING ARRANGEMENT

(75) Inventors: Tyler Eugene Hilsden, St. Catharines (CA); Scott Robert Jamieson, Welland (CA); Henry Friesen, Niagara-on-the-Lake (CA)

(73) Assignee: Deere & Company, Moline, IL (US)

( * ) Notice: Subject to any disclaimer, the term of this patent is extended or adjusted under 35 U.S.C. 154(b) by 761 days.

(21) Appl. No.: 12/915,292

(22) Filed: Oct. 29, 2010

(65) Prior Publication Data

US 2012/0107080 A1 May 3, 2012

(51) Int. Cl.
*E02F 3/627* (2006.01)
*E02F 3/36* (2006.01)

(52) U.S. Cl.
CPC ..... *E02F 3/3604* (2013.01); *E02F 3/3668* (2013.01); *E02F 3/3672* (2013.01); *E02F 3/3695* (2013.01); *E02F 3/627* (2013.01); *Y10S 414/133* (2013.01)
USPC ..... 414/686; 414/685; 414/920; 172/272; 37/403

(58) Field of Classification Search
USPC ..... 414/680, 685, 686, 920; 172/272; 37/403
See application file for complete search history.

(56) References Cited

U.S. PATENT DOCUMENTS

| | | | | |
|---|---|---|---|---|
| 4,345,870 | A * | 8/1982 | Anderson et al. | 414/686 |
| 4,793,764 | A * | 12/1988 | Hamm | 414/686 |
| 4,798,511 | A * | 1/1989 | Kaczmarczyk et al. | 414/686 |
| 7,614,842 | B2 | 11/2009 | Ellefson et al. | |
| 8,500,386 | B2 * | 8/2013 | Griffiths et al. | 414/686 |
| 2009/0127218 | A1 | 5/2009 | Hylen | |
| 2010/0014952 | A1 | 1/2010 | Lougheed | |

* cited by examiner

*Primary Examiner* — Scott Lowe
(74) *Attorney, Agent, or Firm* — Quarles & Brady LLP

(57) ABSTRACT

A loader mast-to-mounting frame pin arrangement is provided. The pin arrangement has stops added to a shaft that allow the pin to be held in two positions: the locked position and the parked position. In the locked position, a unique slot cut in the mast plate retains the pin by not allowing an eccentric protrusion on the shaft from passing through the slot when the pin is rotated to place the shaft in the top of the slot. When the pin is rotated so the shaft is towards the bottom of the slot, the eccentric protrusion is allowed to pass through the mast plate and the pin can be pulled out until it hits another protrusion on the shaft. At this point, the pin will stay in the mast but the loader can be removed from the tractor. To prevent the pin from rotating by itself, when in the locked position, and the loader coming unlatched, a spring loaded knob engages in the slot which prevents the shaft from being able to rotate to the unlocked position. To operate, the knob is pulled back away from the mast and then the shaft can be rotated.

8 Claims, 6 Drawing Sheets

LOADER MAST-TO-MOUNTING FRAME PIN RETAINING ARRANGEMENT

FIELD OF THE INVENTION

The present invention relates to work machines. More Particularly, the invention relates to work machines having detachable front end loaders. Specifically, the invention relates to work machines having detachable front end loaders wherein the loader mast is detachably mounted to a work machine mounting frame by way of removable pins.

BACKGROUND OF THE INVENTION

It is known to provide work machines such as tractors with detachable front mounted implements such as front end loaders. Such loaders can be adapted with buckets, hay forks, pallet forks etc. to perform a variety of tasks. It is further known to provide the work machine with a mounting frame to and from which the loader implement can be attached/detached. The typical means for attaching the loader mast to the mounting frame is to use pins that pass through both the mounting frame and the mast. Current mast-to-mounting frame pin designs e.g. have a bent handle design that passes through a hole in the loader mast. The end of the handle has a cross hole where a spring locking pin is inserted on the inside of the outer mast plate to retain the mast-to-mounting frame pin in the loader mast. This locks the loader to the loader mounting frame that is in turn bolted to the tractor frame. Problems arise as a result of this design. First, users find it difficult to insert the spring locking pin inside the mast because it is difficult to see the hole in the handle after it is inserted into the mast. Second, both the mast-to-mounting frame pin and spring locking pin can be lost if not chained or otherwise affixed to the loader. Attempts to date to solve this problem are either complex with several parts that could fail or have been poorly received by end users.

Accordingly there is a clear need in the art for a loader mast to mounting frame pin arrangement that is simple, secure, and otherwise overcomes the problems associated with prior art designs.

SUMMARY OF THE INVENTION

It is therefore an object of the invention to provide a loader mast-to-mounting frame pin arrangement that eliminates the spring locking pin on the inside of the outer mast plate by replacing it with an easy-to-access knob located on the outside of the mast.

It is another object of the invention to provide a loader mast-to-mounting frame pin arrangement that does not need to be fully removed from the mast to park the loader, allowing users to leave the pin in the loader where it will not get misplaced or lost.

A further object of the invention is to provide a loader mast-to-mounting frame pin arrangement that allows for the pin to be easily removed without any tools or disassembly, if needed.

Yet another object of the invention is to provide such a loader mast-to-mounting frame pin arrangement that is simple to use, inexpensive to manufacture and that is compatible with known work machines and loader implements.

These and other objects are attained by a pin arrangement for removably attaching an implement to a work machine, the work machine having a mounting frame, and the implement having a mast for attachment to the mounting frame, the pin arrangement comprising a pin that engages both the mast and the mounting frame, the improvement comprising: a pin retainer affixed to the pin, the pin retainer having at least a handle and a locking shaft, the locking shaft having at least two eccentric stops and a release knob thereon, the release knob having a retaining portion, the handle and locking shaft being movable between a first position and a second position; and, a slot in the mast, the slot having a first portion that allows passage of one of the at least two eccentric stops when the locking shaft is in the first position and preventing passage of the one of the at least two eccentric stops when the locking shaft is in the second position, the slot having a second portion that selectively engages the retaining portion of the release knob when the locking shaft is in the second position thereby preventing movement of the locking shaft from the second position to the first position, the first portion of the slot preventing passage of the other one of the at least two eccentric stops when the locking shaft is in the first position; whereby the pin is locked in the mast and mounting frame when the locking shaft is in the second position, and the pin can be withdrawn from the mounting frame when the locking shaft is in the first position, but is retained in the mast.

In general a loader mast-to-mounting frame pin arrangement is provided. The pin arrangement has stops added to a shaft that allow the pin to be held in two positions: the locked position and the parked position. In the locked position, a unique slot cut in the mast plate retains the pin by not allowing an eccentric protrusion on the shaft from passing through the slot when the pin is rotated to place the shaft in the top of the slot. When the pin is rotated so the shaft is towards the bottom of the slot, the eccentric protrusion is allowed to pass through the mast plate and the pin can be pulled out until it hits another protrusion on the shaft. At this point, the pin will stay in the mast but the loader can be removed from the tractor. To prevent the pin from rotating by itself, when in the locked position, and the loader coming unlatched, a spring loaded knob engages in the slot which prevents the shaft from being able to rotate to the unlocked position. To operate, the knob is pulled back away from the mast and then the shaft can be rotated.

BRIEF DESCRIPTION OF THE DRAWINGS

For a complete understanding of the objects, techniques, and structure of the invention, reference should be made to the following detailed description and accompanying drawings, wherein.

DESCRIPTION OF THE PREFERRED EMBODIMENT

Figure 1:
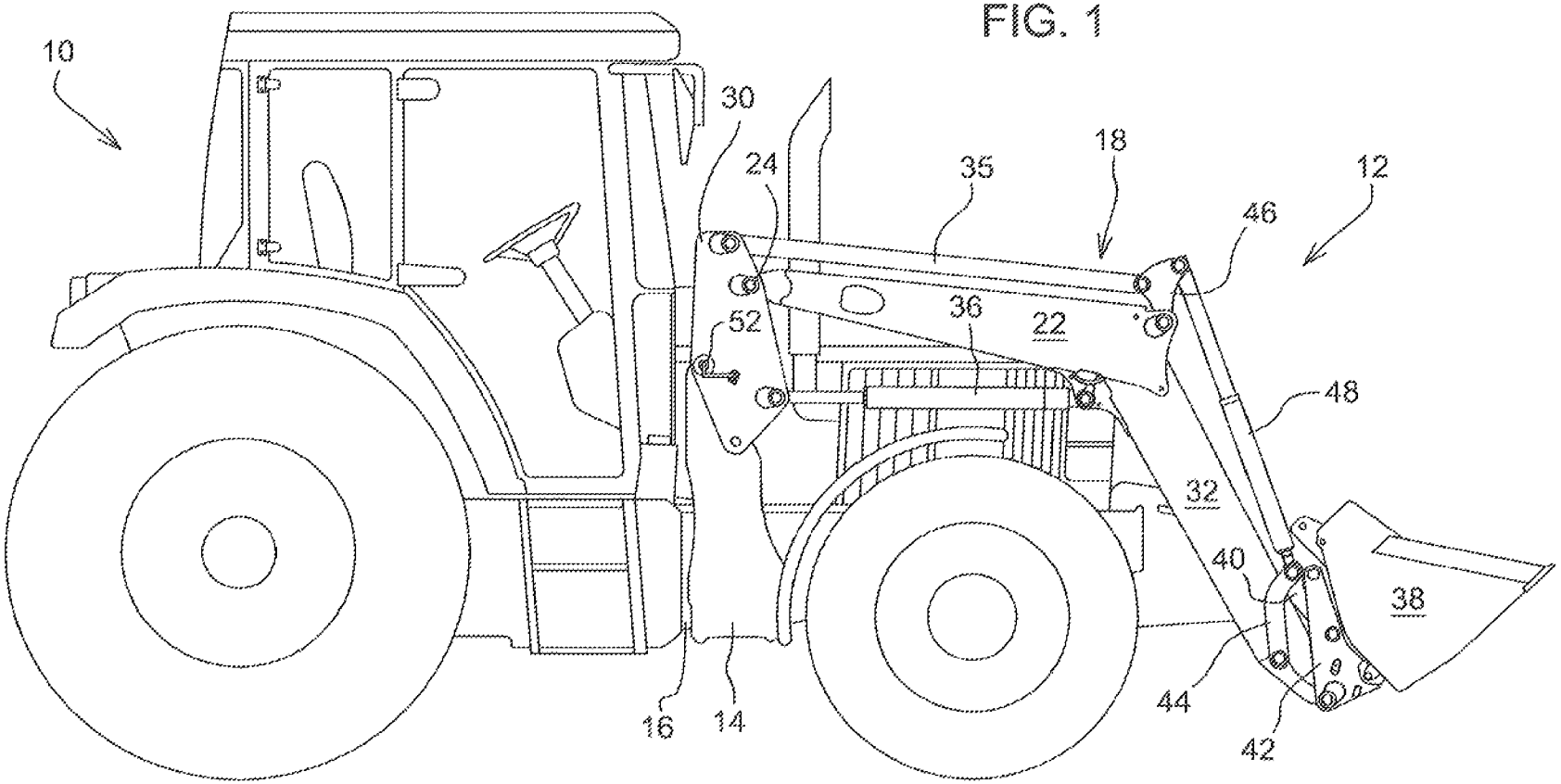
FIG. 1 is a side view of a work machine in the form of a tractor having a front end loader implement.
Figure 2:
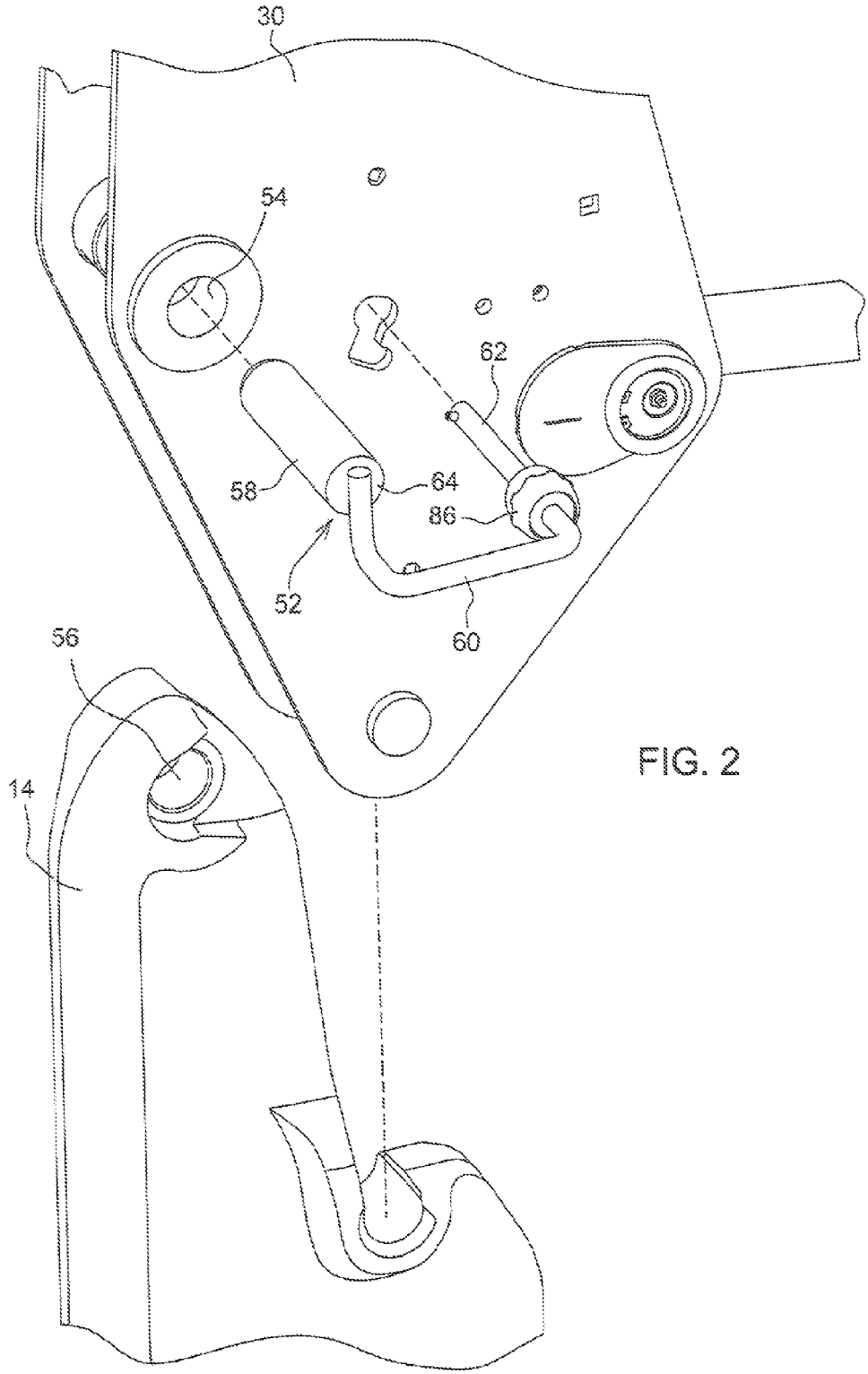
FIG. 2 is perspective view of a portion of a loader mast and tractor mounting frame.

Referring now to FIG. 1 it can be seen that a work machine in the form of a tractor 10 is provided with a front mounted loader implement 12. As shown the tractor 10 is provided with a pair of mounting frames 14 (only one of which is shown) which are bolted or otherwise affixed to a frame 16 of the tractor 10. The loader 12 is of a conventional configuration including a loader boom 18 comprising transversely spaced, right and left, parallel loader arms, with which the boom in a lowered position, as viewed in FIG. 1, respectively includes upper arm sections 22 projecting forwardly from, and having rear ends respectively pivotally mounted, as at connection pins 24, to right and left masts 30, with only a right upper arm section 22 and right mast 30 being shown. Forward ends of the right and left upper arm sections 22 extend forwardly and are respectively coupled to upper ends of lower arm sections 32, which extend downwardly and forwardly so as to define an angle with the upper arm sections 22. Extending between, and joining the lower arm sections 32 at locations spaced upwardly from lower ends of the arm sections is a cross member defined by a cylindrical torque tube (not shown). Coupled between the mast 30 and the junction between the upper and lower arm sections 22 and 32, respectively, is a lift cylinder 36.

Mounted to a lower front location of the lower arm sections 32 is a tool, here shown as a loader bucket 38, with the bucket 38 having transversely spaced mounting hooks at its back side (not shown) for receiving coupling pin portions of a carrier and latching device 42. Right and left leveling linkages 35, are coupled between the masts 30 and bell cranks 46. Attached to one corner of the bell crank 46 is the head end of a hydraulic actuator 48 whose rod end is pivotally attached to one end of drive links 44. The other end of the drive links 44 are attached to the lower arm sections 32. In the configuration shown a connecting link 40 is provided that is also connected at one end to the rod end of the actuator 48 and at its other end to the carrier and latching device 42. Thus the extension and retraction of the actuator 48 serves to roll the tool between dump and rolled back positions.

Figure 3:
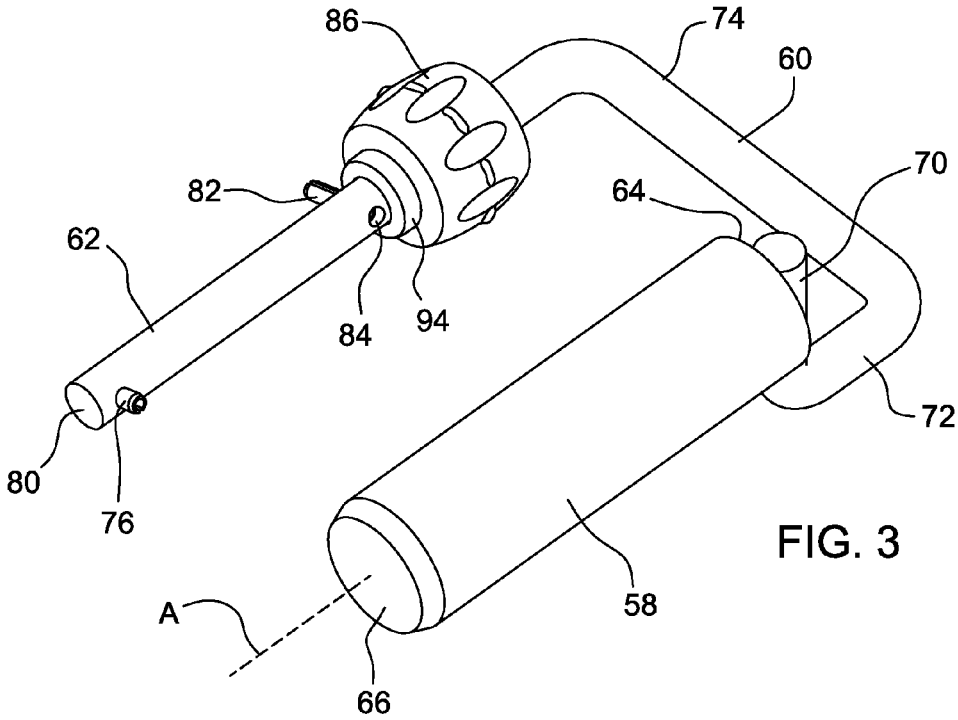
FIG. 3 is a perspective view of an embodiment of a pin retaining arrangement according to the invention.
Figure 4:
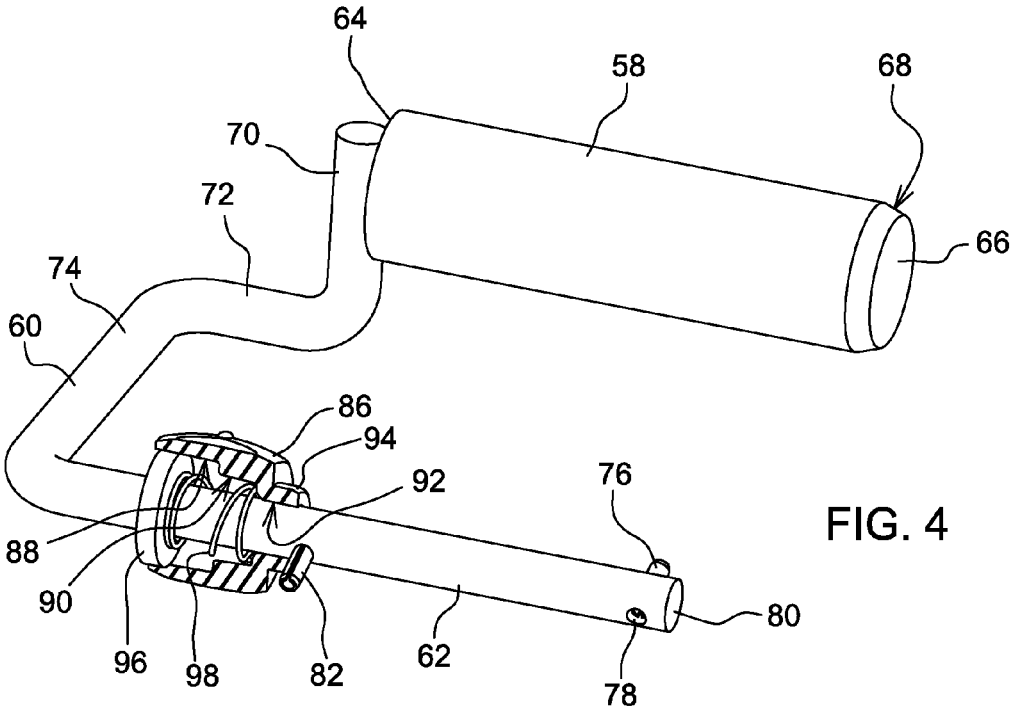
FIG. 4 is a perspective view of the pin retaining arrangement of FIG. 3 taken from a reverse angle and showing the release knob with a section removed.

The loader 12 described thus far is conventional in its configuration. In the description that follows the unique mast-to-mounting frame pin arrangement will be described in more detail. With continued reference to FIG. 1 and also now to FIGS. 2-6 it can be seen that the masts 30 are generally affixed to the mounting frames 14 by way of pins 52 which pass through apertures 54 and 56 in the masts and mounting frames respectively. The pin 52 is unique in its configuration as shown in the detail of FIGS. 3 and 4. More particularly, it can be seen that the pin 52 is comprised generally of three portions. A mast pin element 58, a handle 60, and a locking shaft 62. The mast pin element 58 is an elongated cylinder having first and second ends 64 and 66 respectively. The mast pin element 58 has a diameter that closely fits within the diameter of the pin apertures 54 and 56 of the mast and mounting frames respectively, for removable receipt therein. The second end 66 of the mast pin element 58 preferably has a chamfer 68 so as to facilitate its passage through the apertures 54 and 56. The handle 60 and locking shaft 62 are preferably constructed of a single generally cylindrical bar that is bent as described in more detail below. More particularly, the handle 60 has a first leg 70 that is welded or otherwise affixed to the first end 64 of the mast pin element 58. A second leg 72 is disposed at a substantial right angle to the first leg 70 and is generally parallel to a lengthwise axis A of the mast pin element 58. A third leg 74 is, in turn, disposed at a right angle to the second leg 72 and generally perpendicular to the lengthwise axis A of the mast pin element 58. The locking shaft 62 is bent from the third leg 74 of the handle 60 at a substantial right angle and is thus disposed parallel to the lengthwise axis A of the mast pin element 58. As can be seen a first roll pin 76 is fitted into a first aperture 78 proximal to a distal end 80 of the locking shaft 62. For reasons which will become apparent as the description continues the first roll pin 76 extends outwardly from the locking shaft 62 generally perpendicular to the lengthwise axis A of the mast pin element 58. A second roll pin 82 is similarly disposed in a second aperture 84 located on the locking shaft portion at a spaced distance from the first aperture 78. The second roll pin 82 extends outwardly from the locking shaft portion 62 substantially diametrically opposite the first roll pin 76. Between the second roll pin 82 and the handle 60 is provided a spring loaded release knob 86. As is perhaps best viewed in FIG. 4 the release knob 86 is of a generally hollow barrel shape having a stepped interior diameter comprising a first inner diameter 88, a second inner diameter 90, and a third inner diameter 92. Additionally, the release knob 86 has a stepped outer diameter that forms a locking ring 94. The release knob 86 is disposed on the locking shaft 62 such that the first inner diameter 88 is slidingly disposed about a stop collar 96 that is affixed or otherwise integrated with the locking shaft 62. A coil spring 98 is disposed between the stop collar 96 and a step formed between the second and third inner diameters 90 and 92 and thus tends to bias the release knob 86 away from the stop collar 96.

Figure 5:
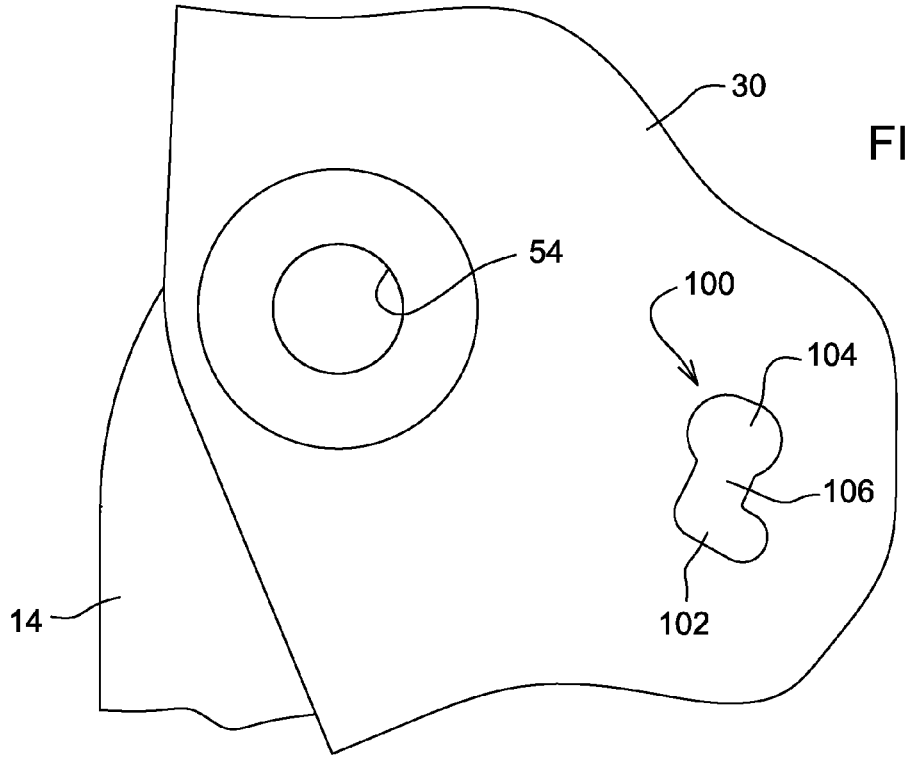
FIG. 5 is a side view of a portion of a loader mast having a locking slot according to the invention.

With reference now to FIG. 5 it can be seen that the mast 30, in addition to the pin aperture 54 noted above, is provided with a locking slot 100. The locking slot 100 has a unique shape, in that it comprises a lower oblong portion 102, an upper oblong portion 104, and an intermediate slot portion 106. For reasons which will become apparent, the upper oblong portion 104 has a width corresponding closely to an outer diameter of the locking ring 94 of the release knob 86, so that the locking ring 94 can be nested therein. The lower oblong portion 102 and the intermediate portion 106 of the locking slot 100 both have widths that are less than the diameter of the locking ring 94 such that the locking ring 94 cannot pass from the upper oblong portion 104 to the lower oblong portion 102 while nested within the slot. The lower oblong portion has a length that is sufficient to allow the passage of the second roll pin 82 provided that the roll pin 82 is aligned properly with the lower oblong portion 102. The width of the intermediate portion 106 is not sufficient to allow the passage of the roll pin when the mast pin portion 58 is engaged with the mast 30.

Figure 6:
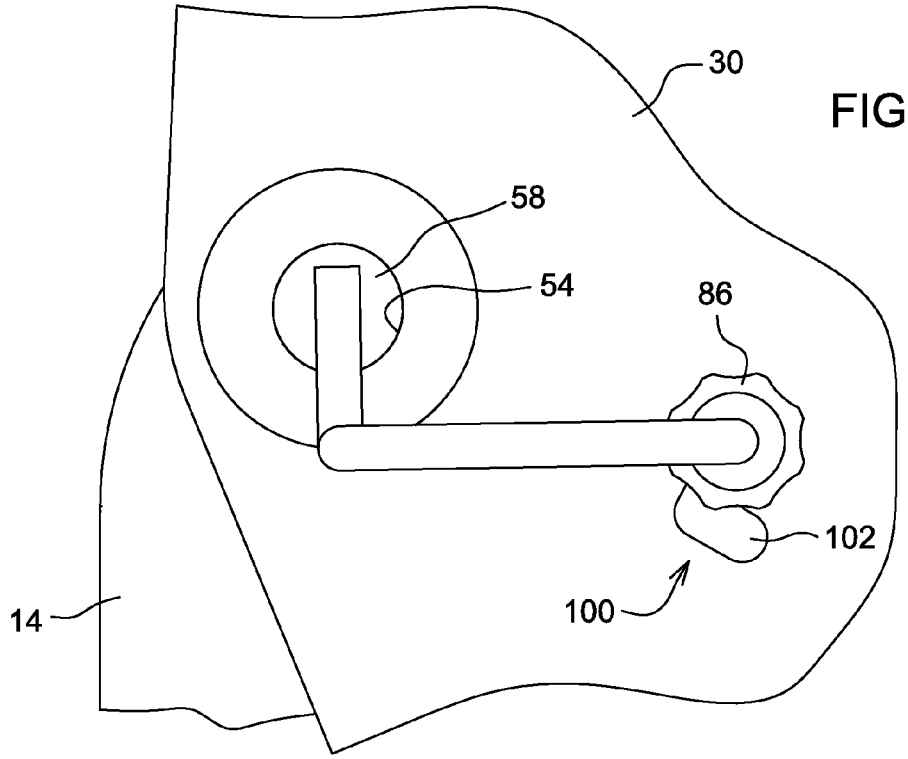
FIG. 6 is a side view of a loader mast with the pin retaining arrangement depicted in a second position.
Figure 7:
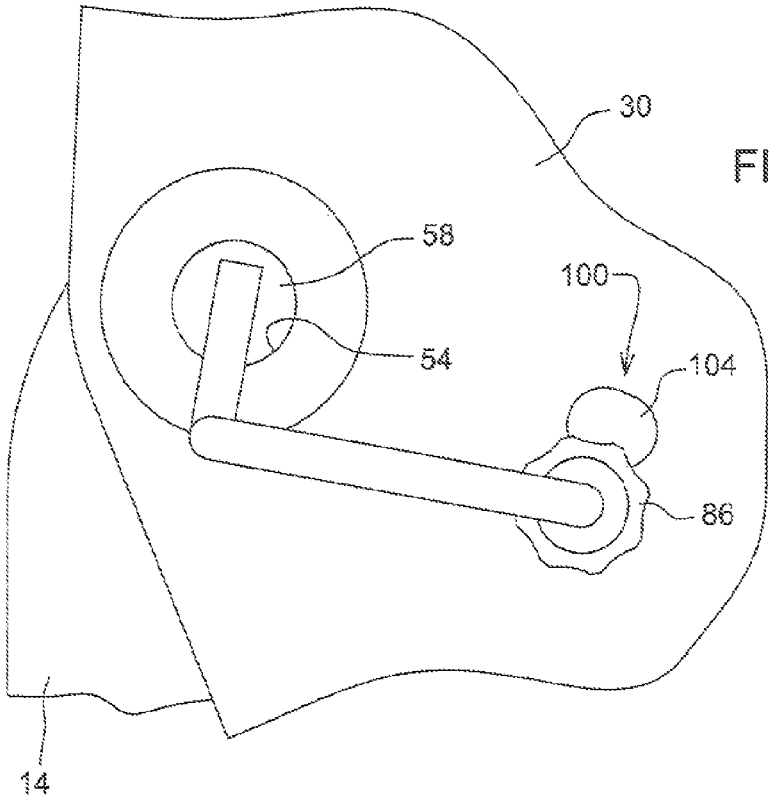
FIG. 7 is a side view of a loader mast with the pin retaining arrangement depicted in a first position.
Figure 8:
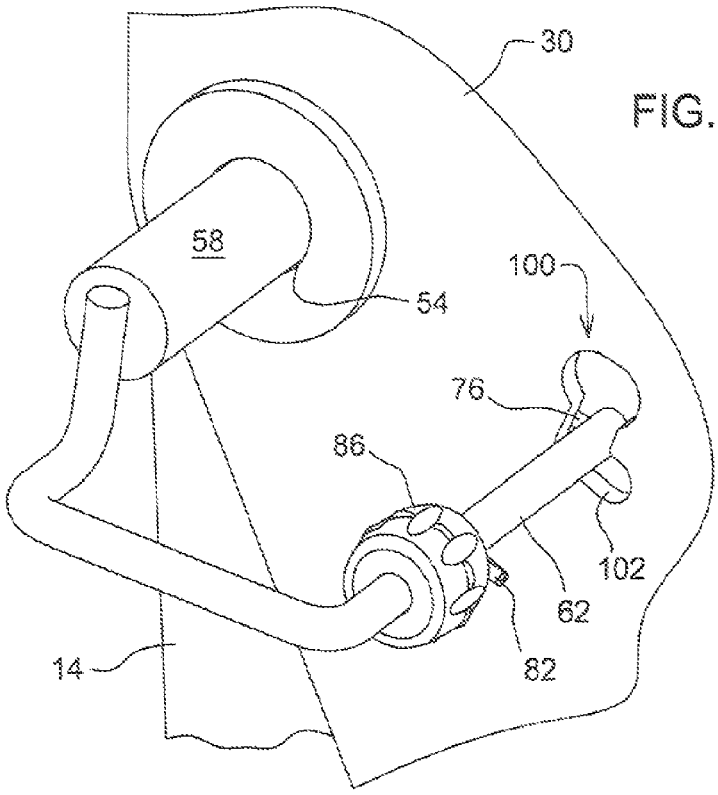
FIG. 8 is a perspective view of the pin retaining arrangement depicted in a first position as in FIG. 7; and, FIG. 9 is a perspective view taken from inside of the loader mast with a pin retaining arrangement according to the invention.
Figure 9:
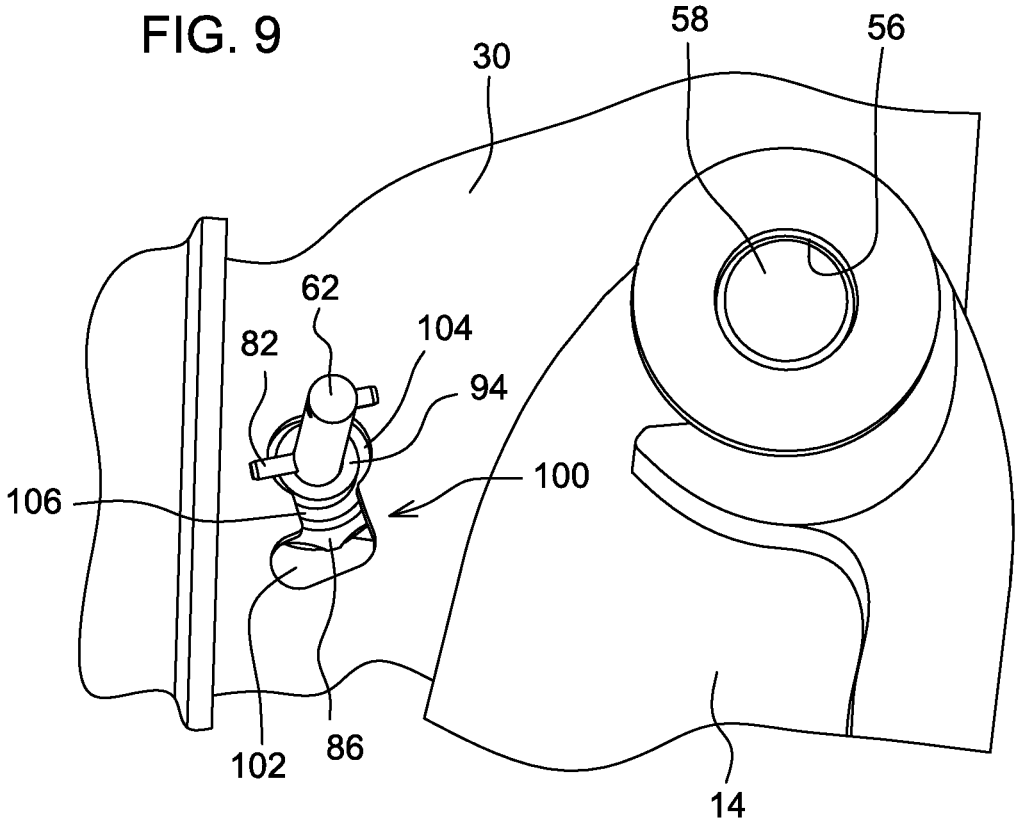

The operation of the mast-to-mounting frame pin arrangement will now be described in more detail with reference to FIGS. 6-9. In the parked position shown in FIG. 8 the mast pin element 58 is standing in the receiving aperture 54 of the mast 30 but has not yet been brought into engagement with the receiving aperture 56 of the mounting frame 14 and the locking shaft 62 is disposed within the lower oblong portion 102 of the slot 100. It should be noted that in this position the second roll pin 82 extending out from the locking shaft portion 62 is aligned to pass through the lower oblong portion 102 of the slot 100. To attach the loader to the mounting frames and lock the pin therein the mast 30 with the pin 52 standing therein is aligned with the mounting frame 14 such that the mast pin element 58 and its receiving aperture 54 on the mast 30 are aligned with the pin receiving aperture 56 of the mounting frame 14. When the apertures 54 and 56 are aligned the operator can then grip the pin arrangement 52 and push the mast pin element 58 into the receiving apertures 56 of the mounting frame until the mast pin element 58 has fully engaged the mounting frame. As the mast pin element 58 is pushed into the mounting frame apertures 56 the second roll pin 82 extending out from the locking shaft 62 passes through the lower oblong portion 102. When the mast pin element 58 is fully seated the spring 98 inside of the release knob 86 has been compressed allowing the locking ring 94 to rest against an outer surface of the mast 30 as shown in FIG. 7. This pinned connection between the mast 30 and the mounting frame 14 is then locked by the operator by partially rotating the handle 60 counter-clockwise as shown in FIG. 6 so as to move the locking shaft 62 through the intermediate portion 106 to the upper oblong portion 104. In this position the second roll pin 82 is prevented from passing back through the slot 100 thereby preventing lateral movement of the mast pin portion 58. At the same time the previously compressed release knob 86 is biased into nested engagement with the upper oblong portion 104 of the slot 100 thereby preventing the possibility that the locking shaft portion 62 can move down to the lower oblong portion 102 until such time that the release knob 86 is compressed.

To release the pin and return to the parked position, the above procedure is generally reversed. More particularly, the operator retracts the release knob 86 thereby compressing the spring 98 and withdrawing the locking ring 94 from the upper oblong portion 104 so as to allow the locking shaft 62 upon a clockwise rotation of the handle 60 to pass through the intermediate portion 106 down to the lower oblong portion 102. Now by simply pulling on the handle 60 the operator can withdraw the mast pin element 58 from the mounting frame apertures 56 as the second roll pin 82 passes through the lower oblong portion 102. The first roll pin 76 extending outward from the locking shaft 62 prevents the locking shaft 62 from being fully withdrawn from the slot 100 inasmuch as it is not oriented to pass through the lower oblong portion 102. Thus the pin arrangement is retained on the loader at all times and is not subject to loss.

It should now be apparent that the mast-to-mounting frame pin arrangement eliminates the spring locking pin on the inside of the mast of the prior art by replacing it with an easy-to-access pin arrangement located on the outside of the mast. Further the pin arrangement does not need to be fully removed from the mast to park the loader, thereby allowing users to leave the pin in the loader where it will not get misplaced or lost yet allows for the pin to be easily removed without any tools or disassembly.

In view of the foregoing it should now be apparent that variations of the described embodiment are possible without departing from the scope of the invention. For example it would be possible to construct the pin arrangement as a unitary structure or as an arrangement of multiple parts. The roll pins described above could be replaced by eccentrics of various shapes formed integrally or fastened to the locking shaft. Additionally, in lieu of the locking ring other means for preventing the unintentional rotation of the locking shaft can be employed such as by the provision of stops or detents on the release knob that mate with like shaped portions of the slot and/or prevent the release knob from moving in the slot until the release knob is pulled back.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The invention claimed is:

1. A pin arrangement for removably attaching an implement to a work machine, the work machine having a mounting frame, and the implement having a mast for attachment to the mounting frame, the pin arrangement comprising a pin that engages both the mast and the mounting frame, the improvement comprising:

a pin retainer affixed to the pin, the pin retainer having at least a handle and a locking shaft, the locking shaft spaced apart from the pin and having at least two eccentric stops projectinq from the locking shaft and a release knob thereon, the release knob having a retaining portion, the handle and locking shaft being movable between a first position and a second position; and, a slot in the mast, the slot having a first portion that allows passage of one of the at least two eccentric stops when the locking shaft is in the first position and preventing passage of the one of the at least two eccentric stops when the locking shaft is in the second position, the slot having a second portion that selectively engages the retaining portion of the release knob when the locking shaft is in the second position thereby preventing movement of the locking shaft from the second position to the first position, the first portion of the slot preventing passage of the other one of the at least two eccentric stops when the locking shaft is in the first position;

whereby the pin is locked in the mast and mounting frame when the locking shaft is in the second position, and the pin can be withdrawn from the mounting frame when the locking shaft is in the first position, but is retained in the mast.

2. The pin arrangement according to claim 1, wherein the release knob has a spring member that biases the retaining portion of the knob toward the mast.

3. The pin arrangement according to claim 2, wherein the release knob is disposed around a stop affixed to the locking shaft and the spring member biases the handle away from the stop.

4. The pin arrangement according to claim 3, wherein the stop is a collar.

5. The pin arrangement according to claim 1, wherein the first portion of the slot is connected to the second portion of the slot by a third portion, the third portion having a width that is narrower than a width of the retaining portion of the release knob.

6. The pin arrangement according to claim 1, wherein the pin retainer further comprises a first leg that is affixed to the pin.

7. The pin arrangement according to claim 1 wherein the work machine is a tractor.

8. The pin arrangement according to claim 1 wherein the implement is a front end loader.

* * * * *